US008322972B2

(12) United States Patent
Sanchez

(10) Patent No.: US 8,322,972 B2
(45) Date of Patent: Dec. 4, 2012

(54) STEAMPATH FLOW SEPARATION REDUCTION SYSTEM

(75) Inventor: Nestor Hernandez Sanchez, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 525 days.

(21) Appl. No.: 12/612,854

(22) Filed: Nov. 5, 2009

(65) Prior Publication Data

US 2011/0103944 A1 May 5, 2011

(51) Int. Cl.
*F01D 9/04* (2006.01)

(52) U.S. Cl. ..... 415/58.7; 415/116

(58) Field of Classification Search ..... 415/116, 415/144, 58.5, 58.7

See application file for complete search history.

(56) References Cited

U.S. PATENT DOCUMENTS 2,703,477 A * 3/1955 Anxionnaz ..... 60/262
2,956,732 A * 10/1960 Stalker ..... 415/181
3,735,593 A * 5/1973 Howell ..... 60/226.1
4,615,657 A * 10/1986 Kreitmeier ..... 415/104
4,688,988 A * 8/1987 Olsen ..... 415/116
7,137,245 B2 * 11/2006 Graziosi et al. ..... 60/262
2006/0202082 A1 9/2006 Alvi
2008/0131262 A1 * 6/2008 Lee et al. ..... 415/115

FOREIGN PATENT DOCUMENTS

JP 58-155204 * 9/1983
JP 2003293997 10/2003

OTHER PUBLICATIONS

Tatsuo, Steam Turbine, Sep. 14, 1983, Abstract of JP58-155204.*

* cited by examiner

*Primary Examiner* — Ninh H Nguyen
*Assistant Examiner* — Liam McDowell
(74) *Attorney, Agent, or Firm* — Hoffman Warnick LLC; Ernest G. Cusick

(57) ABSTRACT

A system for reducing flow separation in a turbo machine is provided, the system including a stationary vane coupled to a stationary vane support; at least one circumferential extraction band through the stationary vane or the stationary vane support; the circumferential extraction band having a first side proximate to an operative fluid flow through the turbo machine; at least one opening in the first side of the circumferential extraction band; and a channel having a first end in fluid connection with the circumferential extraction band and a second end extending through the stationary vane support, such that the operative fluid flow through the turbo machine is redirected through the extraction opening into the circumferential extraction band and through the channel towards a rotating blade.

15 Claims, 4 Drawing Sheets

STEAMPATH FLOW SEPARATION REDUCTION SYSTEM

BACKGROUND OF THE INVENTION

The invention relates generally to turbo machines. More particularly, the invention relates to a steampath flow separation reduction system for a steam turbine.

The steampath efficiency in a steam turbine is a result of a multiple loss parameters and their interaction, these parameters are associated with aerodynamic and flow of fluids losses. Efforts have been made to understand and reduce those losses by improving blade profiles, reducing wall losses, gap losses and minimizing radial and circumferential efficiency variations as well as preventing flow separation.

Typically, it is desired to decrease the overall footprint of a steam turbine, for example, to develop less expensive steam turbines and to minimize the amount of necessary floor space to house the steam turbine. However, as the footprint of the steam turbine is decreased, the stages within the steam turbine are moved together, and the wall angles between the stages gets steeper. As wall angles increase, the steam flowing through the turbine, especially in low pressure sections, where wall angles are the highest, becomes agitated due to gaps and vortices, and flow separation occurs. Flow separation can cause significant steampath efficiency losses. Therefore, current systems tend to limit wall angles, especially in the low-pressure sections, to 45-50 degrees to prevent flow separation. Various attempts have been made to resdesign the steampath in order to reduce flow separation, including blade profile improvements and nozzle root modifications, such as using an L0 hump.

BRIEF DESCRIPTION OF THE INVENTION

A system for reducing flow separation in a turbo machine is provided, the system including a stationary vane coupled to a stationary vane support; at least one circumferential extraction band through the stationary vane or the stationary vane support; the circumferential extraction band having a first side proximate to an operative fluid flow through the turbo machine; at least one opening in the circumferential extraction band; and a channel having a first end in fluid connection with the circumferential extraction band and a second end extending through the stationary vane support, such that the operative fluid flow through the turbo machine is redirected through the extraction opening into the circumferential extraction band and through the channel towards a rotating bucket.

A first aspect of the invention provides a stationary vane support for a turbo machine, the stationary vane support coupled to a stationary vane, the stationary vane support comprising: a circumferential extraction band positioned in the stationary vane support, the extraction band having a first side proximate to an operative fluid flow through the turbo machine; an opening in the first side of the circumferential extraction band; and a channel through the stationary vane support, the channel having a first end in fluid communication with the circumferential extraction band and a second end proximate to a tip region near a downstream rotating blade, the channel and the circumferential extraction band configured such that a portion of the operative fluid flow through the turbo machine is redirected through the extraction opening into the circumferential extraction band and through the channel towards the downstream rotating blade.

A second aspect of the invention provides a stationary vane support for a turbo machine, the stationary vane support coupled to a stationary vane, the stationary vane support comprising: a protrusion extending from the stationary vane support towards an upstream rotating bucket; a circumferential extraction band in the protrusion, the circumferential extraction band having a first side proximate to an operative fluid flow through the turbo machine; at least one opening in the first side of the circumferential extraction band; and a channel through the stationary vane support, the channel having a first end in fluid communication with the circumferential extraction band and a second end proximate to a tip region near a downstream rotating blade, the channel and circumferential extraction band configured such that a portion of the operative fluid flow through the turbo machine is redirected through the extraction opening into the circumferential extraction band and through the channel towards the downstream rotating blade.

A third aspect of the invention provides a system for reducing flow separation in a turbo machine, the system comprising: a first rotating blade; a second rotating blade; a stationary vane disposed between the first rotating blade and the second rotating blade, the stationary vane coupled to a stationary vane support; a protrusion extending from the stationary vane towards the first rotating blade; a circumferential extraction band in one of the protrusion and the stationary vane support, the circumferential extraction band having a first side proximate to an operative fluid flow through the turbo machine; at least one opening in the first side of the circumferential extraction band; and a channel through one of the protrusion and the stationary vane support, the channel having a first end in fluid communication with the circumferential extraction band and a second end proximate to a tip region near the second rotating blade, the channel and circumferential extraction band configured such that a portion of the operative fluid flow through the turbo machine is redirected through the extraction opening into the circumferential extraction band and through the channel towards the second rotating blade.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention.

DETAILED DESCRIPTION OF THE INVENTION

At least one embodiment of the present invention is described below in reference to its application in connection with and operation of a turbo machine in the form of a steam turbine. However, it should be apparent to those skilled in the art and guided by the teachings herein that the present invention is likewise applicable to any suitable turbine and/or engine. In addition, while embodiments of this invention refer to redirection of a steam flow in a steam turbine, it is understood that the present invention is applicable to the redirection of any operative fluid used in a suitable turbine and/or engine.

Figure 1:
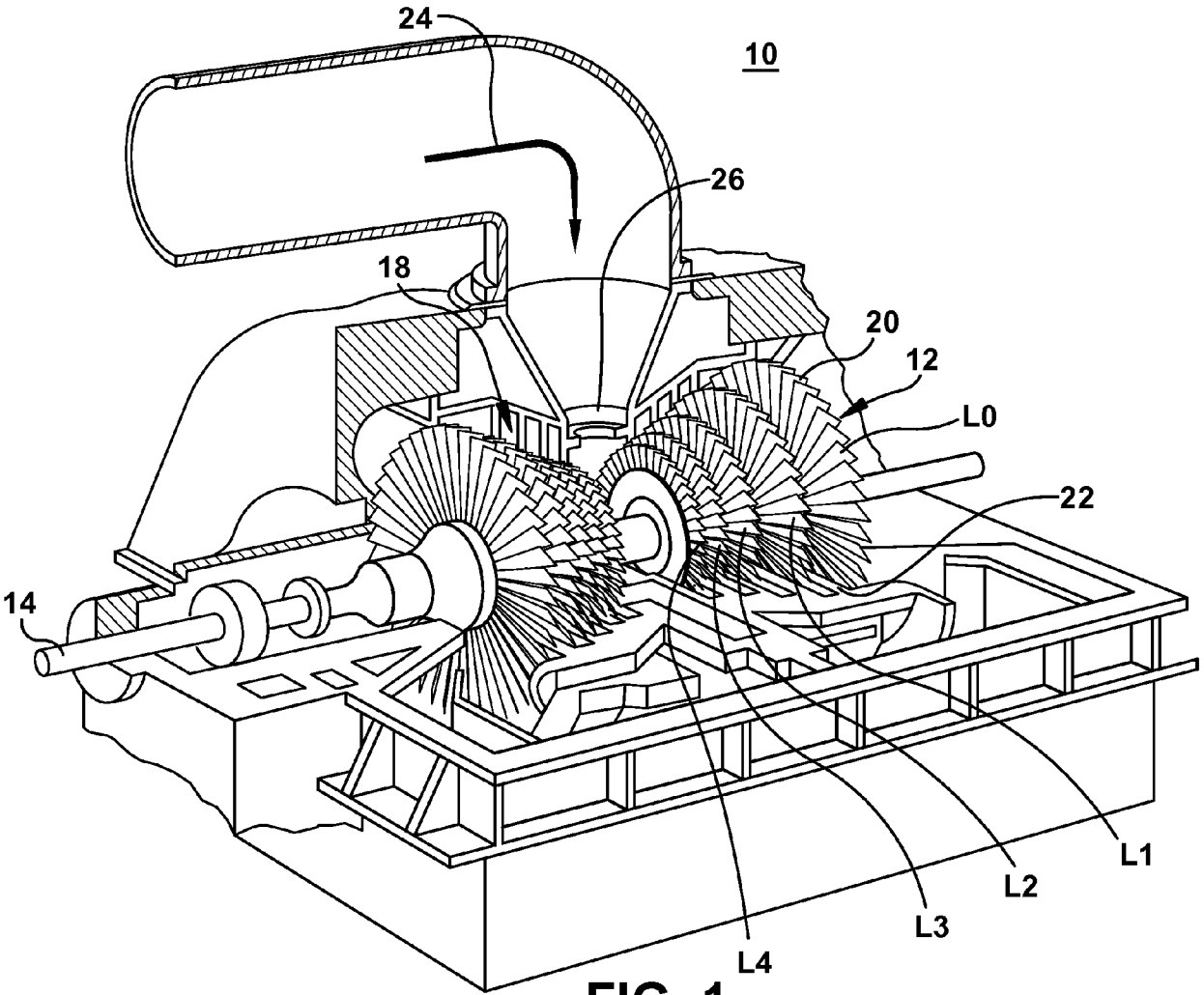
FIG. 1 Prior Art
FIG. 1 shows a perspective partial cut-away view of a conventional steam turbine.

Referring to the drawings, FIG. 1 shows a perspective partial cut-away illustration of a steam turbine 10. Steam turbine 10 includes a rotor 12 that includes a rotating shaft 14 and a plurality of axially spaced rotor wheels 18. A plurality of rotating airfoils 20 (also referred to as blades 20) are mechanically coupled to each rotor wheel 18. More specifically, blades 20 are arranged in rows that extend circumferentially around each rotor wheel 18. A plurality of stationary vanes 22 extends circumferentially around shaft 14, and the vanes are axially positioned between adjacent rows of blades 20. Stationary vanes 22 cooperate with blades 20 to form a stage and to define a portion of an operative fluid flow path through turbine 10.

In operation, an operative fluid 24, such as steam, enters an inlet 26 of turbine 10 and is channeled through stationary vanes 22. Vanes 22 direct operative fluid 24 downstream against blades 20. Operative fluid 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine.

As shown in FIG. 1, turbine 10 comprises at least one stage (five stages shown in FIG. 1). The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). As the operative fluid moves through the various stages, the pressure drops, i.e., the operative fluid is at a higher pressure at stage L4 than at stage L0. It is to be understood that five stages are shown as one example only, and each turbine may have more or less than five stages.

Figure 2:
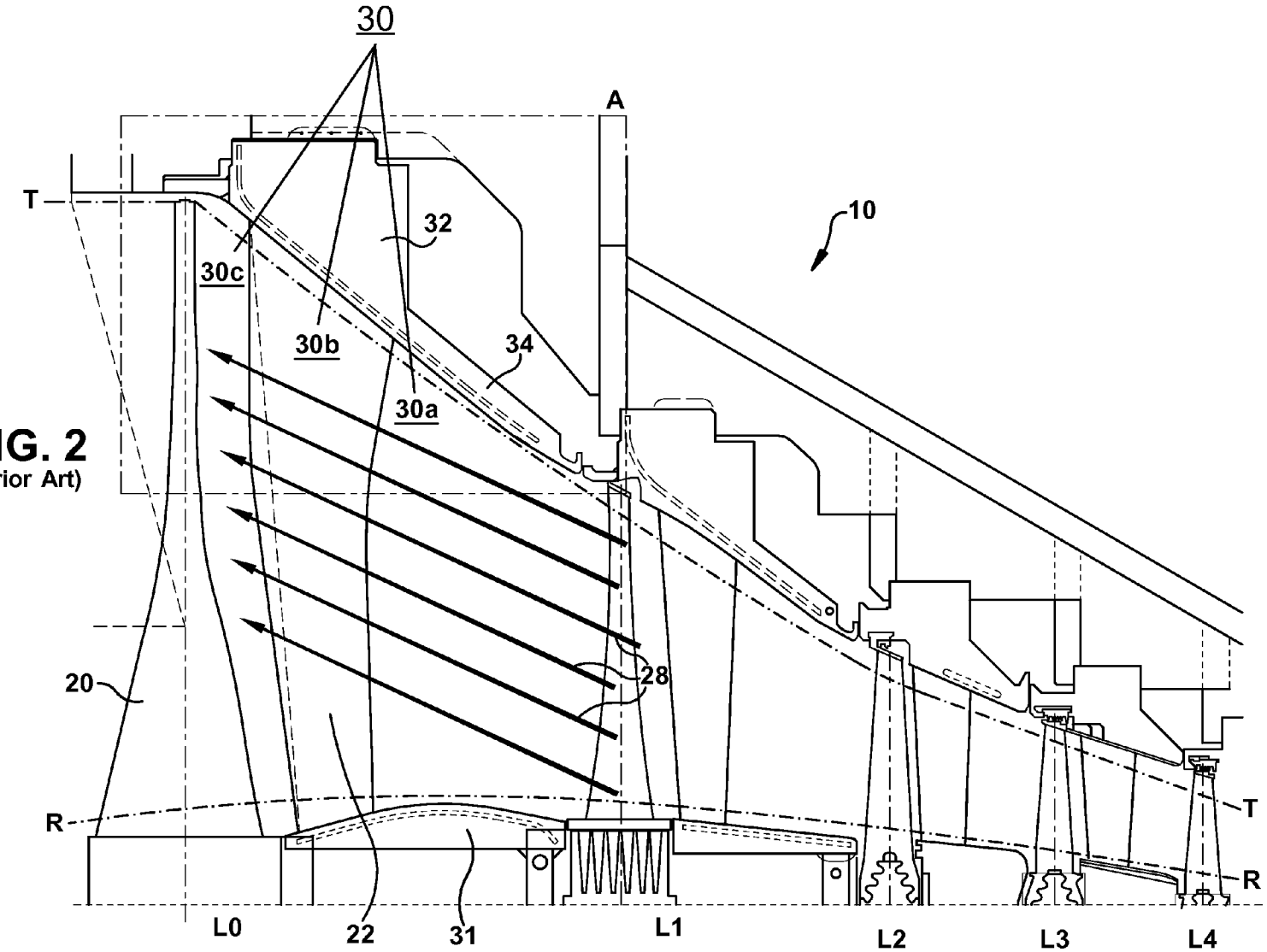
FIG. 2 (Prior Art)
FIG. 2 shows a cross-sectional view of an illustrative stage of a conventional steam turbine.

FIG. 2 shows a cross-sectional view of the multiple stages of turbine 10. Focusing on stages L0 and L1, rotating blade 20 and stationary vane 22 are shown, with stationary vane 22 supported, in part, by a stationary vane support 32. Stationary vane support 32 can further include a protrusion 34, also referred to as a nozzle nose, which extends from stationary vane support 32 towards the previous stage of the turbine, for example from stationary vane support 32 in stage L0 towards stage L1. The area along stationary vane support 32 and protrusion 34 is generally referred to as a tip region T of the stage, illustrated by line T in FIG. 2, while the area along an opposite end of stationary vane 22 is referred to as a root region R of the stage, illustrated by line R in FIG. 2.

As FIG. 2 illustrates, the wall angles between the stages, particularly between stage L0 and L1, are steep. Therefore, the flow of steam through turbine 10, illustrated by arrows 28, will become agitated as it gets caught up in the gaps/vortices that will inherently be present in areas above arrows 28 near tip region T (generally shown as area 30 in FIG. 2), especially in low pressure sections of a turbine. For ease of illustration, area 30 is shown in FIG. 2 as three areas, area 30*a* near tip region T and protrusion 34, area 30*b* near tip region T and stationary vane 22, and area 30*c* near tip region T and rotating blade 20. However, it is understood that in actual practice, areas 30*a*, 30*b* and 30*c* are not necessarily three distinct areas and are collectively referred to herein as area 30. As shown in FIG. 2, an L0 hump 31 can be included near root region R of stationary vane 22 of the L0 stage. Hump 31 acts to push the flow 28 of steam up from root region R of the stage to attempt to reduce flow separation by forcing the steam to fill in the gaps/vortices in area 30. However, use of hump 31 alone may not adequately reduce flow separation.

Figure 3:
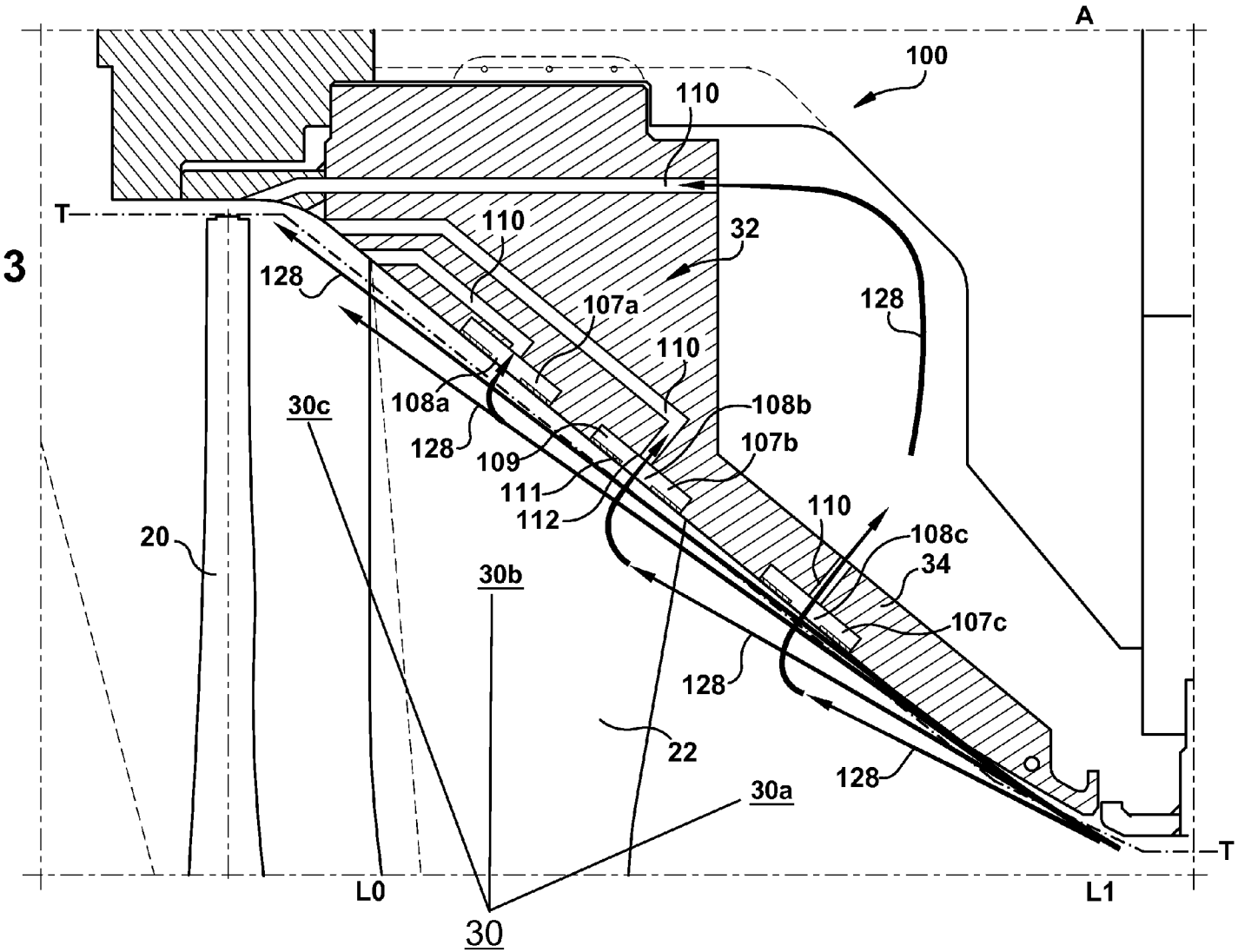
FIG. 3 shows a cross-sectional view of an illustrative stage of a steam turbine according to an embodiment of the invention.

An illustrative stage of a steam turbine including a steam flow separation reduction system 100 according to embodiments of this invention is shown in FIG. 3. Specifically, FIG. 3 shows an enlarged view within dotted line A in FIG. 2, showing stages L0 and L1 according to embodiments of the invention. As shown in FIG. 3, stage L0 of system 100 includes rotating blade 20 and stationary vane 22, with stationary vane 22 supported, in part, by stationary vane support 32. Stationary vane support 32 further includes a protrusion 34, extending out from stationary vane support 32 towards a rotating bucket of the previous stage (stage L1 in FIG. 3).

Figure 4:
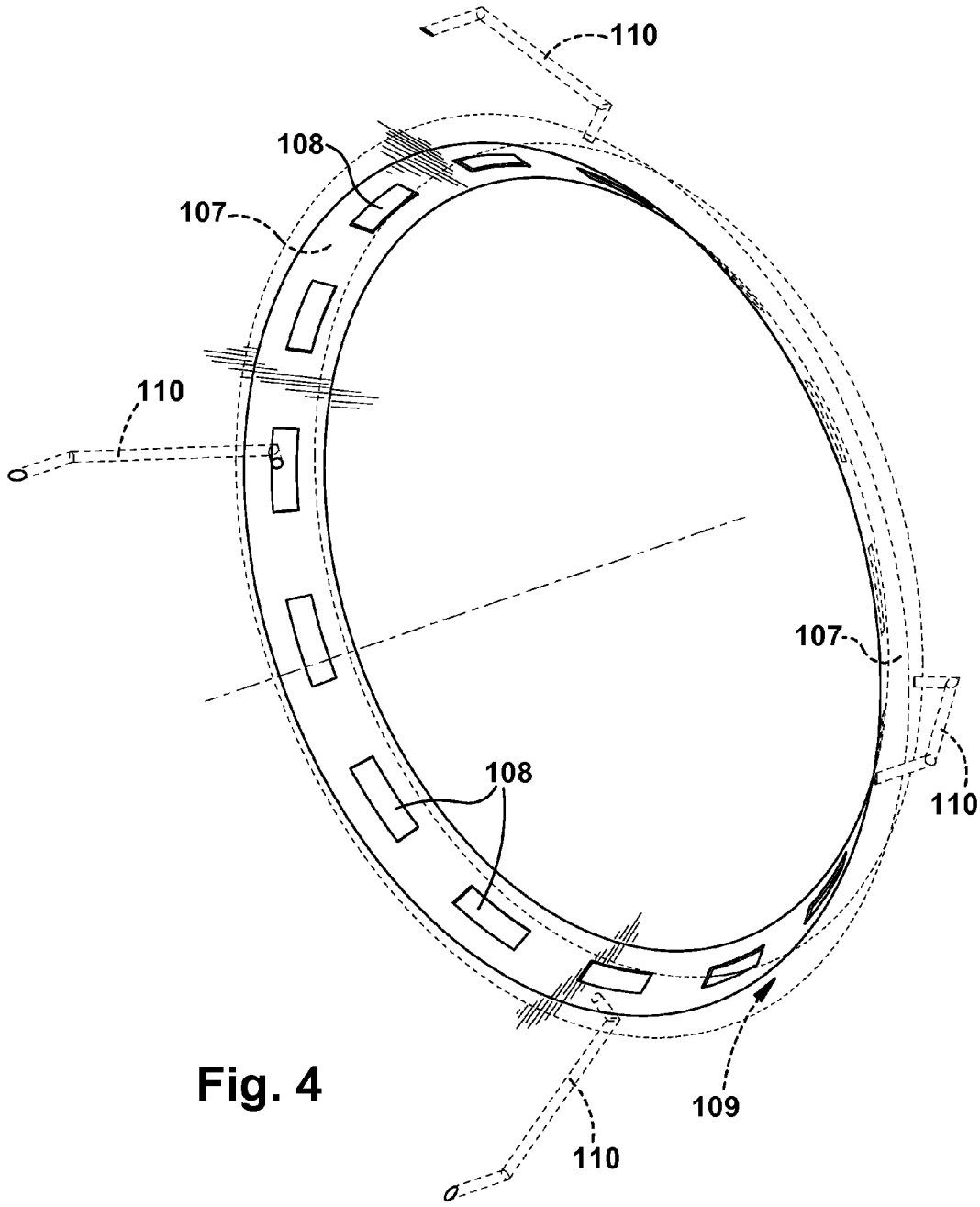
FIG. 4 shows a three-dimensional view of the extraction band used in a stage of a steam turbine according to an embodiment of the invention.

In accordance with an embodiment of this invention, at least one extraction band 107 is provided circumferentially around the stage of the turbine, as shown in FIGS. 3 & 4. (Three extraction bands 107*a*, 107*b* and 107*c* are shown in FIG. 3, and it is understood that reference herein to "extraction band 107" refers to one or more of bands 107*a*, 107*b* and/or 107*c*). FIG. 4 shows a three-dimensional view of one illustrative extraction band 107. As shown in FIGS. 3 and 4, each extraction band 107 has an internal cavity 109, capable of containing fluid. Each extraction band 107 further includes a plurality of extraction openings 108 (shown as openings 108*a*, 108*b* and 108*c* in FIG. 3) along an inner side 111 of extraction band 107 adjacent to the operative fluid path of the stage to allow operative fluid 128 to enter cavity 109. In this way, operative fluid 128 is redirected as indicated by arrows 128 (FIG. 3).

As shown in FIGS. 3 and 4, each extraction band 107 can further be in fluid communication with at least one channel 110. As illustrated in FIG. 3, channels 110 can connect to a outer side 112 of extraction band 107 to direct operative fluid flow 128 from internal cavities 109 of extraction bands 107 through stationary vane 22 towards rotating blade 20. As such, channels 110 each have one end in fluid communication with extraction band 107 and another end open to area 30, near tip region T.

Extraction bands 107 can be located as desired near tip region T of stationary vane 22, for example, extraction bands 107 can be located in stationary vane support 32 adjacent to stationary vane 22, and/or in protrusion/nozzle nose 34. While three extraction bands 107*a*, 107*b* and 107*c* are shown in FIG. 3 (107*a* and 107*b* in stationary vane 22 and 107*c* in protrusion/nozzle nose 34), any number of extraction bands 107 and openings 108 can be included in accordance with embodiments of this invention to redirect as much operative fluid flow 128 as desired through channels 110 to areas 30. As shown in FIG. 3, the act of drawing steam flow 128 through extraction openings 108 draws steam flow 128 up towards tip region T, and therefore into area 30*a* nearest to projection 34 and area 30*b* nearest to stationary vane 22. Comparing FIGS. 2 and 3, it is understood that redirected steam flow 128 (FIG. 3) is closer to tip region T than natural steam flow 28 (FIG. 2).

Extraction openings 108 can be positioned all around extraction band 107, thus allowing for an almost 360 degree flow extraction. As the flow enters internal cavity 109 of extraction band 107, it will be directed through one of the channels 110. While shown as rectangular openings, positioned at regular intervals, extraction openings 108 can be any shape or size desired, and can be positioned as desired along extraction band 107. Extraction openings 107 can further comprise a single annular opening, or can be a series of separate openings.

While four channels 110 are shown in FIG. 4, any number of channels 110 can be utilized to redirect steam flow 128. In addition, channels 110 can be any shape or size desired in order to move steam flow 128 through extraction openings 108 and areas 30. For example, as shown in FIG. 3, channels 110 can be positioned entirely within stationary vane 22 or partially within stationary vane 22 and partially within stationary vane support 32, or partially within protrusion 34. Channels 110 can be a series of connected channels, or a single machined channel. In addition, channels 110 can be curved or straight, or a combination of both curved and straight. Regardless of their position, shape or size, channels 110 will be in fluid communication with extraction bands 107 to redirect a portion of steam flow 128 from upstream of stationary vane 22 to downstream of stationary vane 22, i.e., through extraction openings 108, into extraction band 107, and through channels 110 towards rotating blade 20.

As noted, the pressure near stage L1 is higher than near stage L0, therefore this differential in pressure is utilized to pull steam through extraction openings 108 into extraction bands 107 and through channels 110 towards rotating blade 20. In this way, at least part of the natural steampath (illustrated by arrows 28 in FIG. 2) is pulled upwards and redirected (as illustrated by arrows 128 in FIG. 3) in order to fill in the gaps/vortices that can exist in areas 30 due to the high wall angles between stage L0 and L1. This redirection of steam reduces the recirculation and turbulence in areas 30, which will improve steampath efficiency and allow for steeper wall angles.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 wt %, or, more specifically, about 5 wt % to about 20 wt %", is inclusive of the endpoints and all intermediate values of the ranges of "about 5 wt % to about 25 wt %," etc).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A stationary vane support for a turbo machine, the stationary vane support coupled to a stationary vane, the stationary vane support comprising:

a frusto-conical circumferential extraction band positioned in the stationary vane support, the frusto-conical circumferential extraction band having a first side proximate to an operative fluid flow upstream of the stationary vane;

an extraction opening in the first side of the frusto-conical circumferential extraction band; and a channel through the stationary vane support, the channel having a first end in fluid communication with the frusto-conical circumferential extraction band and a second end proximate to a tip region downstream of the stationary vane and upstream of a downstream rotating blade, the channel and the frusto-conical circumferential extraction band configured such that a portion of the operative fluid flow upstream of the stationary vane is redirected through the extraction opening into the frusto-conical circumferential extraction band and through the channel towards an upstream side of the downstream rotating blade.

2. The stationary vane support of claim 1, wherein the frusto-conical circumferential extraction band includes a plurality of circumferential extraction bands.

3. The stationary vane support of claim 1, wherein the channel includes a plurality of channels.

4. The stationary vane support of claim 1, further comprising a hump proximate to a root region of the stationary vane to move the operative fluid flow outwards toward the stationary vane support.

5. The stationary vane support of claim 1, wherein the opening in the frusto-conical circumferential extraction band is configured to draw the operative fluid flow upstream of the stationary vane towards a tip region upstream of the stationary vane.

6. A stationary vane support for a turbo machine, the stationary vane support coupled to a stationary vane, the stationary vane support comprising:

a protrusion extending from the stationary vane support towards an upstream rotating blade;

a frusto-conical circumferential extraction band in the protrusion, the frusto-conical circumferential extraction band having a first side proximate to an operative fluid flow upstream of the stationary vane;

at least one extraction opening in the first side of the frusto-conical circumferential extraction band; and a channel through the stationary vane support, the channel having a first end in fluid communication with the frusto-conical circumferential extraction band and a second end proximate to a tip region downstream of the stationary vane and upstream of a downstream rotating blade, the channel and frusto-conical circumferential extraction band configured such that a portion of the operative fluid flow upstream of the stationary vane is redirected through the extraction opening into the frusto-conical circumferential extraction band and through the channel towards an upstream side of the downstream rotating blade.

7. The stationary vane support of claim 6, wherein the frusto-conical circumferential extraction band includes a plurality of circumferential extraction bands.

8. The stationary vane support of claim 6, wherein the channel includes a plurality of channels.

9. The stationary vane support of claim 6, further comprising a hump proximate to a root region of the stationary vane to move the operative fluid flow outwards toward the stationary vane support.

10. The stationary vane support of claim 6, wherein the opening in the frusto-conical circumferential extraction band is configured to draw the operative fluid flow upstream of the stationary vane towards a tip region upstream of the stationary vane.

11. A system for reducing flow separation in a turbo machine, the system comprising:

a first rotating blade;

a second rotating blade;

a stationary vane disposed between the first rotating blade and the second rotating blade, the stationary vane coupled to a stationary vane support;

a protrusion extending from the stationary vane towards the first rotating blade;

a frusto-conical circumferential extraction band in one of the protrusion and the stationary vane support, the frusto-conical circumferential extraction band having a first side proximate to an operative fluid flow upstream of the stationary vane;

at least one extraction opening in the first side of the frusto-conical circumferential extraction band; and a channel through one of the protrusion and the stationary vane support, the channel having a first end in fluid communication with the frusto-conical circumferential extraction band and a second end proximate to a tip region downstream of the stationary vane and upstream of the second rotating blade, the channel and the frusto-conical circumferential extraction band configured such that a portion of the operative fluid flow upstream of the stationary vane is redirected through the extraction opening into the frusto-conical circumferential extraction band and through the channel towards an upstream side of the second rotating blade.

12. The system of claim 11, wherein the frusto-conical circumferential extraction band includes a plurality of circumferential extraction bands.

13. The system of claim 11, wherein the channel includes a plurality of channels.

14. The system of claim 11, further comprising a hump proximate to a root region of the stationary vane to move the operative fluid flow upwards toward the stationary vane support.

15. The system of claim 11, wherein the opening in the frusto-conical circumferential extraction band is configured to draw the operative fluid flow upstream of the stationary vane towards a tip region upstream of the stationary vane.

* * * * *